US010347105B2

(12) United States Patent
Nagata et al.

(10) Patent No.: US 10,347,105 B2
(45) Date of Patent: Jul. 9, 2019

(54) SECURITY TAG AND BASE STATION FOR DISPLAY

(71) Applicant: One Source Industries, LLC, Irvine, CA (US)

(72) Inventors: Lance Yoshinori Nagata, Irvine, CA (US); Ronald J. Pulvermacher, Sun Prairie, WI (US); Donald Weier, Sun Prairie, WI (US); David J. Pulvermacher, Sun Prairie, WI (US)

(73) Assignee: One Source Industries, LLC, Irvine, CA (US)

( * ) Notice: Subject to any disclaimer, the term of this patent is extended or adjusted under 35 U.S.C. 154(b) by 0 days.

(21) Appl. No.: 16/125,463

(22) Filed: Sep. 7, 2018

(65) Prior Publication Data

US 2019/0073887 A1 Mar. 7, 2019

Related U.S. Application Data

(60) Provisional application No. 62/555,549, filed on Sep. 7, 2017.

(51) Int. Cl.
*G08B 13/26* (2006.01)
*G08B 13/24* (2006.01)

(52) U.S. Cl.
CPC ..... *G08B 13/26* (2013.01); *G08B 13/2417* (2013.01); *G08B 13/2462* (2013.01); *G08B 13/2468* (2013.01); *G08B 13/2482* (2013.01)

(58) Field of Classification Search
CPC ..... G08B 13/26; G08B 13/2417; G08B 13/2462; G08B 13/2468; G08B 13/2482
See application file for complete search history.

(56) References Cited

U.S. PATENT DOCUMENTS

| | | | | |
|---|---|---|---|---|
| 7,928,845 | B1 | 4/2011 | LaRosa | |
| 2011/0021254 | A1 | 1/2011 | Fyke | |
| 2012/0256743 | A1* | 10/2012 | Horton | G08B 21/0244 340/539.13 |

FOREIGN PATENT DOCUMENTS

| | | | |
|---|---|---|---|
| WO | WO 2009/052526 | A2 | 4/2009 |
| WO | WO 2011/037604 | A1 | 3/2011 |
| WO | WO 2015/084856 | A1 | 6/2015 |
| WO | WO 2016/210069 | A1 | 12/2016 |

OTHER PUBLICATIONS

Liszewski, Andrew; OH GIZMO!; About Us; Tenbu's nio Is Kind of Like a Car Alarm for Your Cellphone; in 2 pages Mar. 30, 2009; http://www.ohgizmo.com/2009/03/30/tenbu-nio-is-kind-of-like-a-car-alarm-for-your-cellphone/ 1/.

International Search Report and Written Opinion for International Application No. PCT/US18/50037 dated Dec. 27, 2018, 14 pages.

* cited by examiner

*Primary Examiner* — Curtis B Odom
(74) *Attorney, Agent, or Firm* — Knobbe, Martens, Olson & Bear, LLP

(57) ABSTRACT

A wireless, proximity-based security system for securing or tracking a valuable object. The system includes a base station and a plurality of security fobs. The security fobs are tracked via an ultra-wideband transceiver relative to an outer perimeter. An administrator fob pairs each of the security fobs with the base station. An audible alarm emits from base and/or the fobs when the location of the security fob is detected to be beyond the outer perimeter. A haptic alarm emits from fob when the location of the security fob is detected to be beyond a sub-perimeter.

20 Claims, 12 Drawing Sheets

SECURITY TAG AND BASE STATION FOR DISPLAY

CROSS REFERENCE

This application claims the benefit of U.S. Provisional Patent Application No. 62/555,549, filed Sep. 7, 2017, the entirety of which is hereby incorporated by reference.

BACKGROUND

Field

The present disclosure relates to security and notification—for example, wireless security tags and real time location systems.

Description of Related Art

One of the advantages of a brick-and-mortar retailer establishments over online shopping is that brick-and-mortar retailers enable a customer to have a personal, hands-on interaction with a an electronic device before purchasing. This hands-on experience has continued to justify the existence of brick-and-mortar stores, despite growing online sales across the world. As consumer electronics have become smaller, facilitating this hands-on experience has become more problematic. These problems include theft and breakage of merchandise, which can reduce the number of devices available for demonstration. The response by retailers has been varied and typically includes keeping small electronics devices behind glass panes or otherwise secured in locations that are less accessible to customers. However, this can leave customers no better off than buying online. Another solution implemented by retailers is to have a store employee facilitate each customer's hands-on interaction. However, this solution requires additional employee time, which can be expensive and may be limited by the number of employees that are available to offer demonstrations.

Another solution for retailers of small consumer electronics is a physical tether system. Each consumer electronic device can be tethered with a security tether to a fixed surface such as a table. This facilitated hands-on interaction by multiple consumers while still providing security for the retailers. Physical tethering also has drawbacks because it can restrict even trial usage of the tethered devices to a certain extent.

SUMMARY

The present disclosure explains that, for certain types of consumer electronics, the security tether was detrimental to consumers' hands-on experience, particularly at, but not limited to, retail establishments. For example, using a security tether with a stylus or smartpen and a phone or tablet failed to provide a satisfactory writing experience and failed to showcase the full capabilities and ease-of-use of the styluses and smartpens. Tethering restrictions have these drawbacks for various devices, and not just those provided as examples here. Smaller device are particularly affected by physical tethers because these devices are normally so light and mobile. A tethered pen can feel very awkward in comparison to a pen with no constraints, for example. It can also seem aesthetically compromised if physically tethered to a line robust enough to prevent theft, no matter how flexible or long that line may be. The disclosed inventions and embodiments address these drawbacks with security approaches that do not require a physical tether to a desk or display furniture.

DETAILED DESCRIPTION

Figure 1:
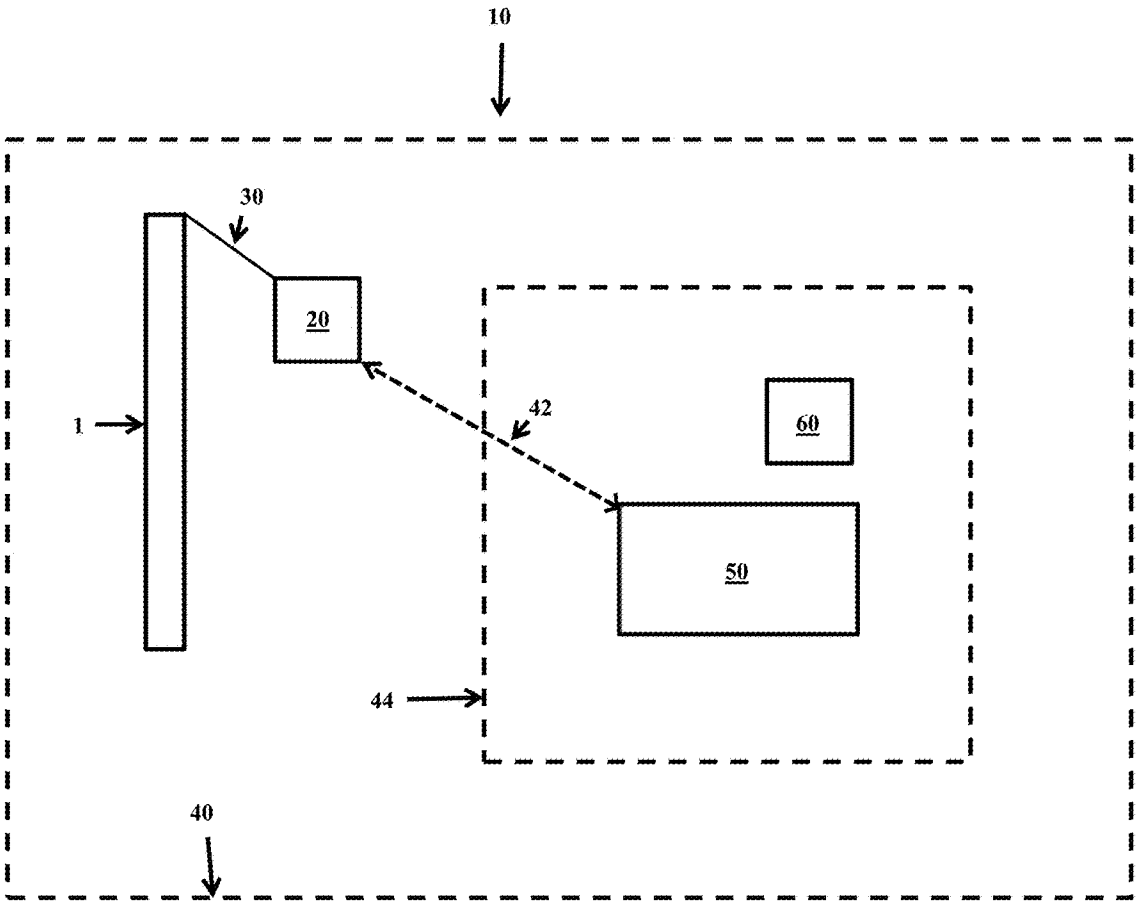
FIG. 1 illustrates a schematic embodiment of a wireless security system for a smart pen display.
Figure 2A:
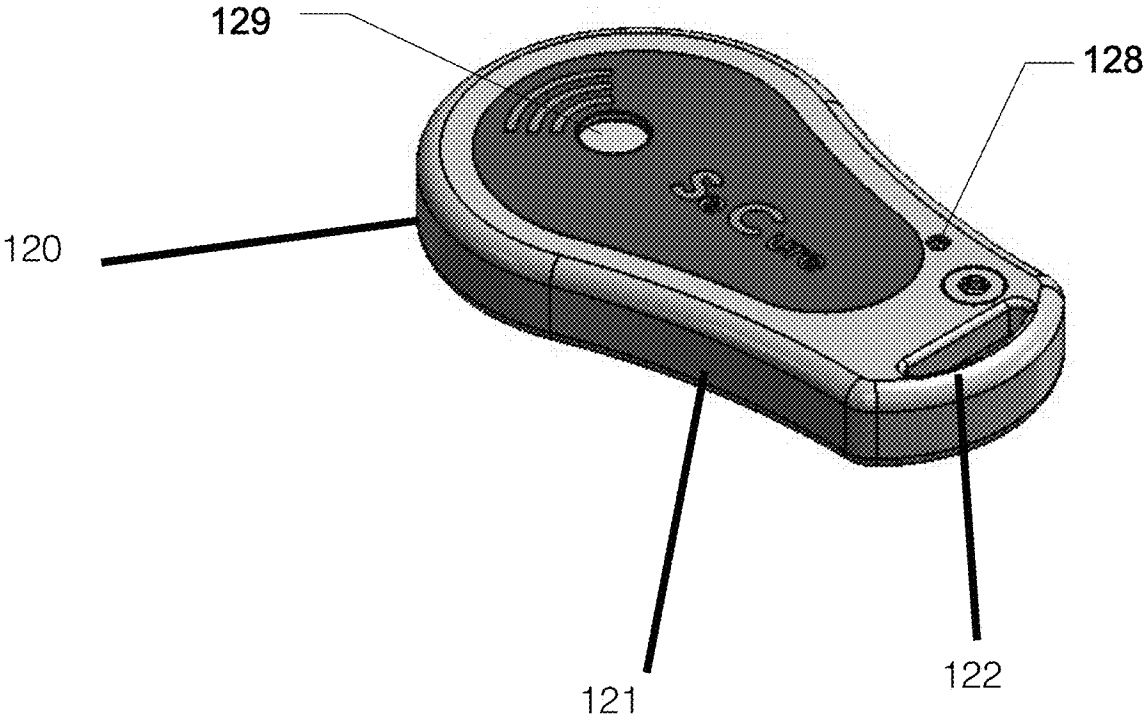
FIG. 2A illustrates an embodiment of a wireless security fob.
Figure 2B:
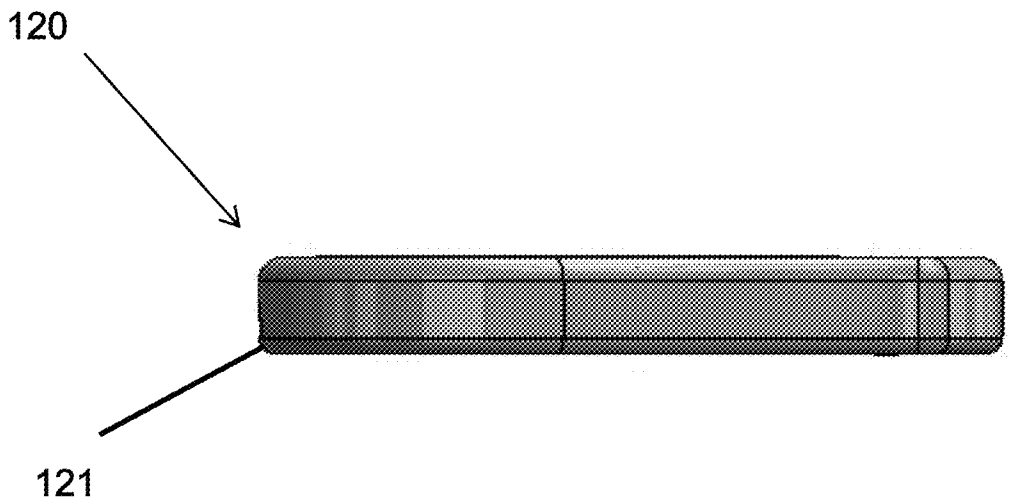
FIG. 2B is a side view of the wireless security fob of FIG. 2A.
Figure 2C:
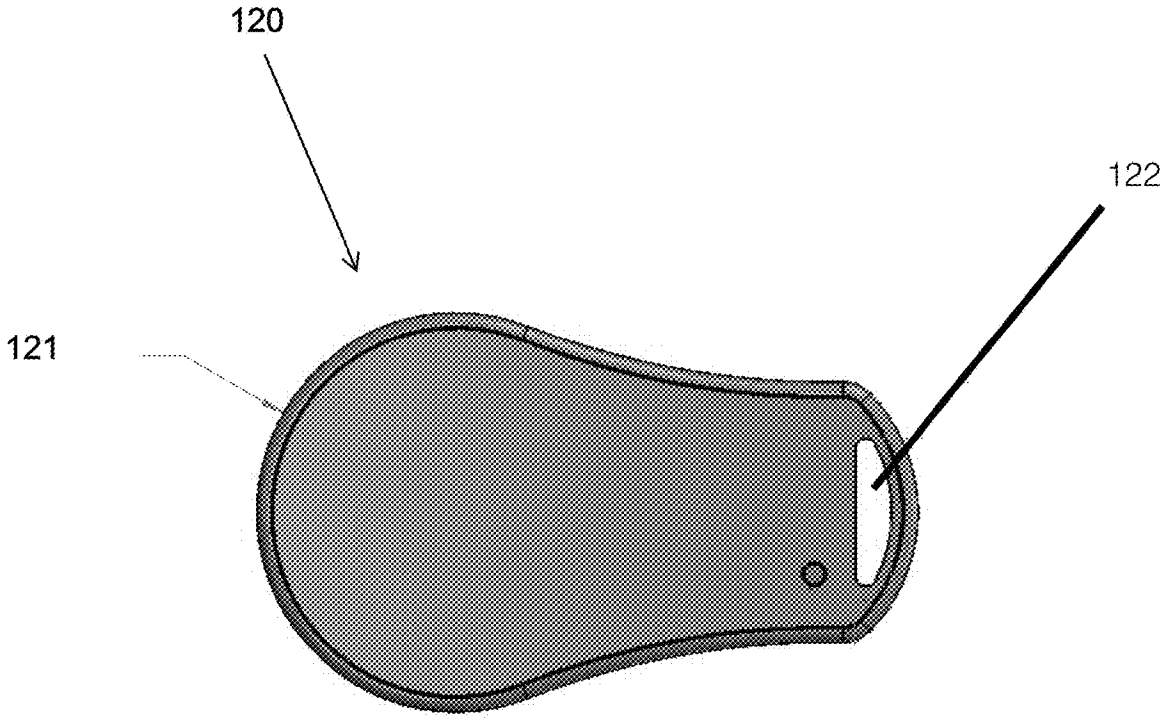
FIG. 2C is a bottom view of the wireless security fob of FIG. 2A.
Figure 2D:
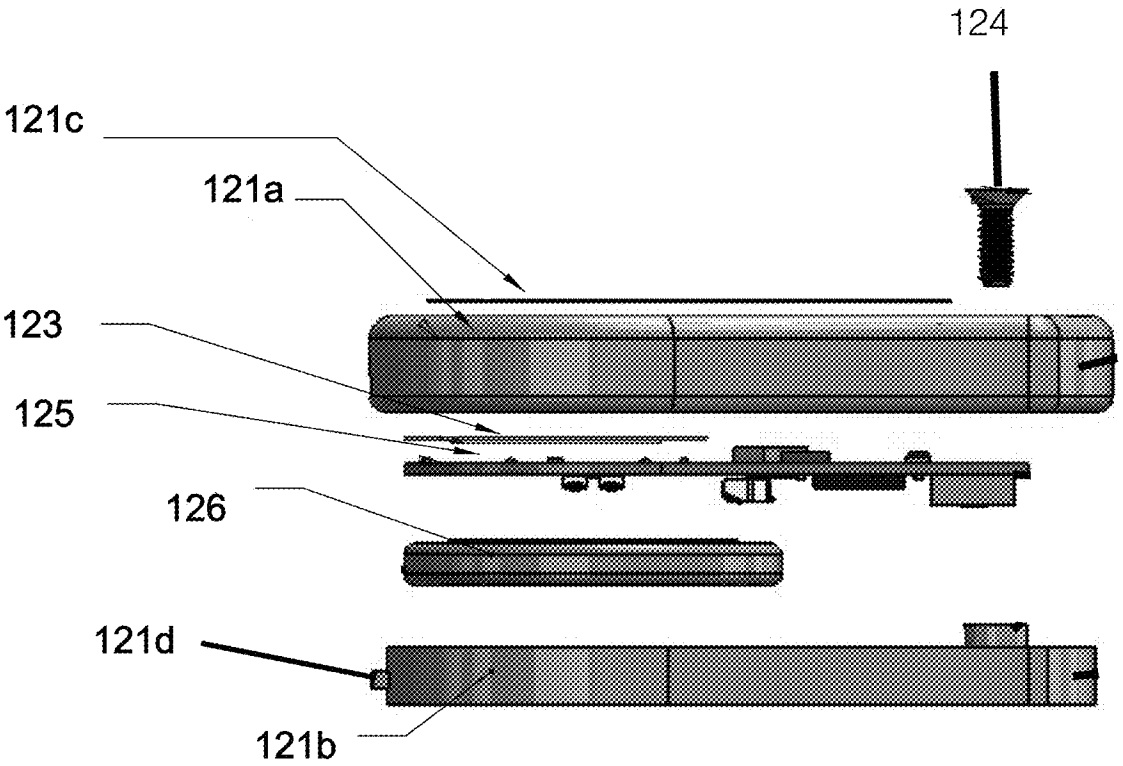
FIG. 2D is an exploded view of the wireless security fob of FIG. 2A.
Figure 3A:
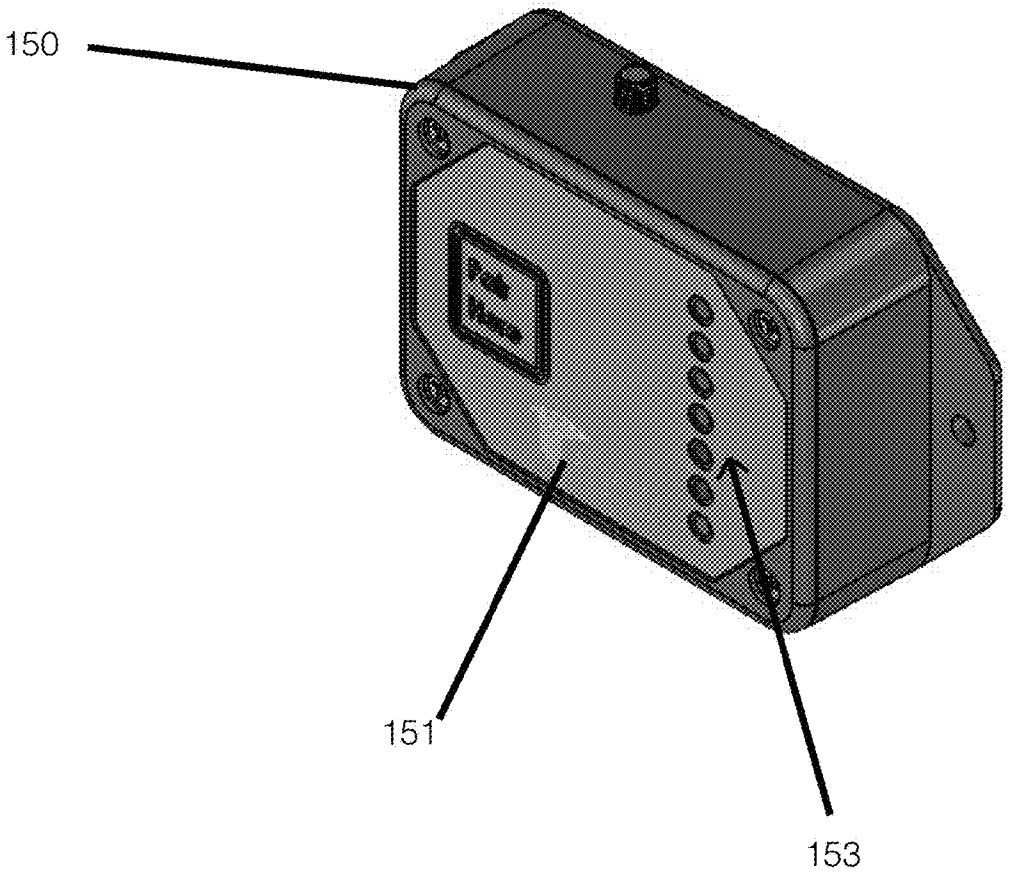
FIG. 3A illustrates an embodiment of a base station of a wireless security system.
Figure 3B:
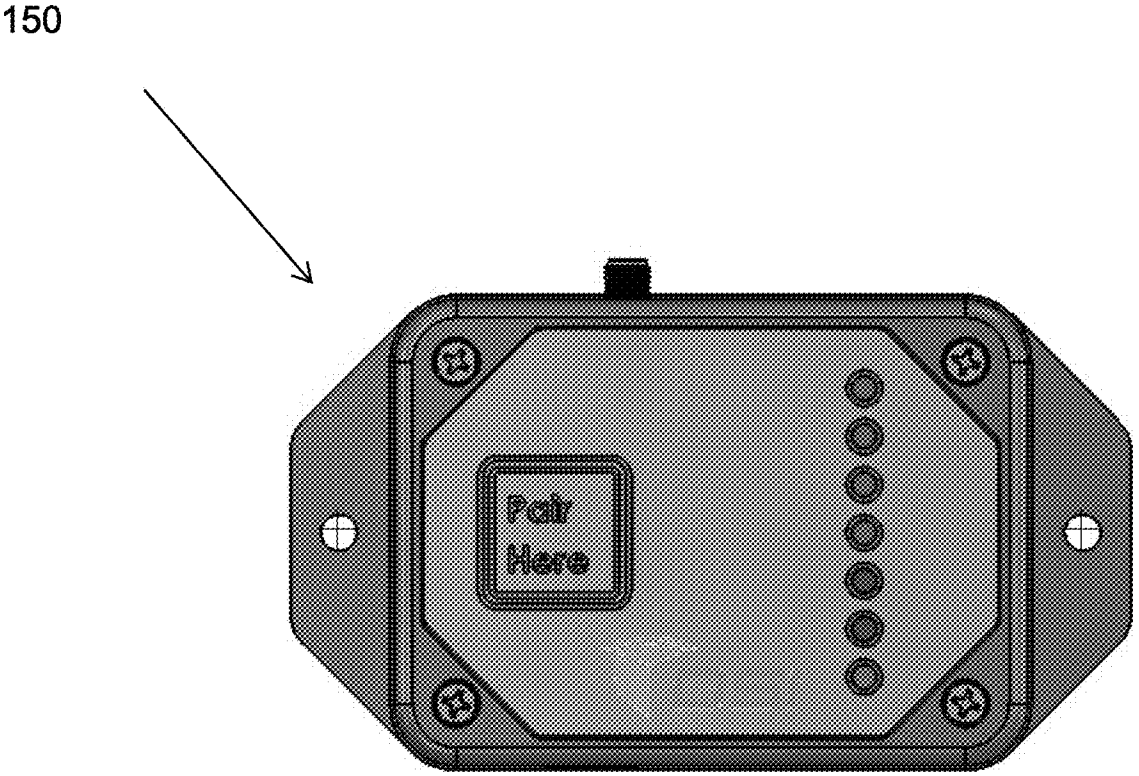
FIG. 3B is a top view of the base station of FIG. 3A.
Figure 3C:
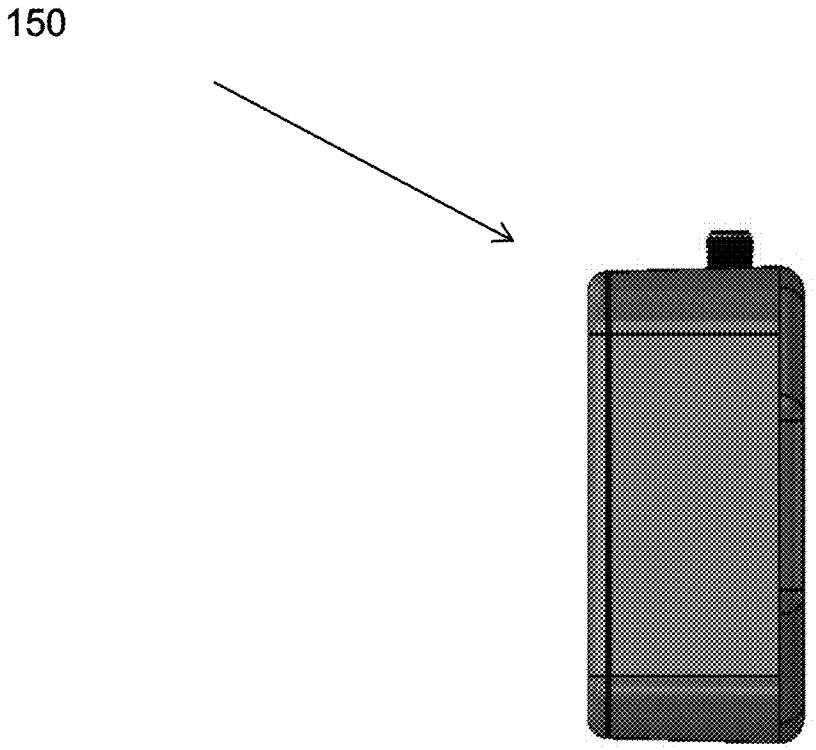
FIG. 3C is a side view of the base station of FIG. 3A.
Figure 3D:
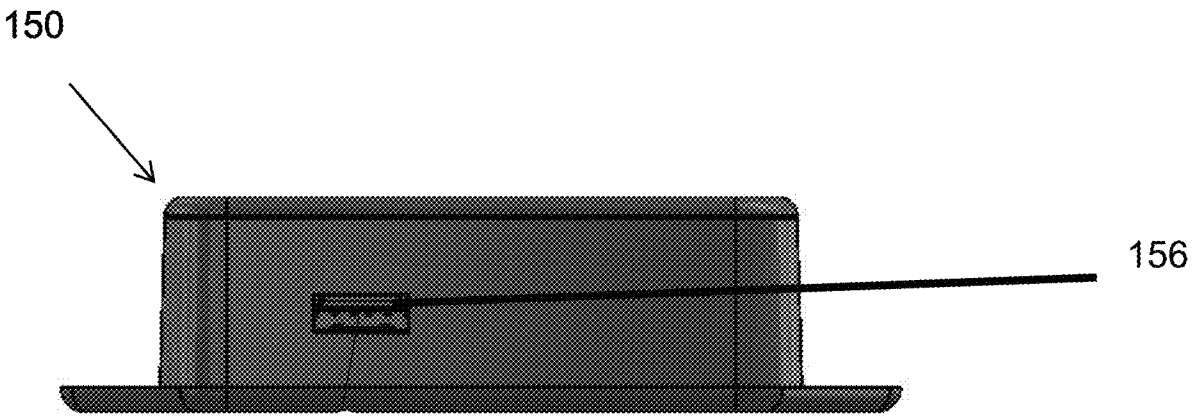
FIG. 3D is a front view of the base station of FIG. 3A.
Figure 4:
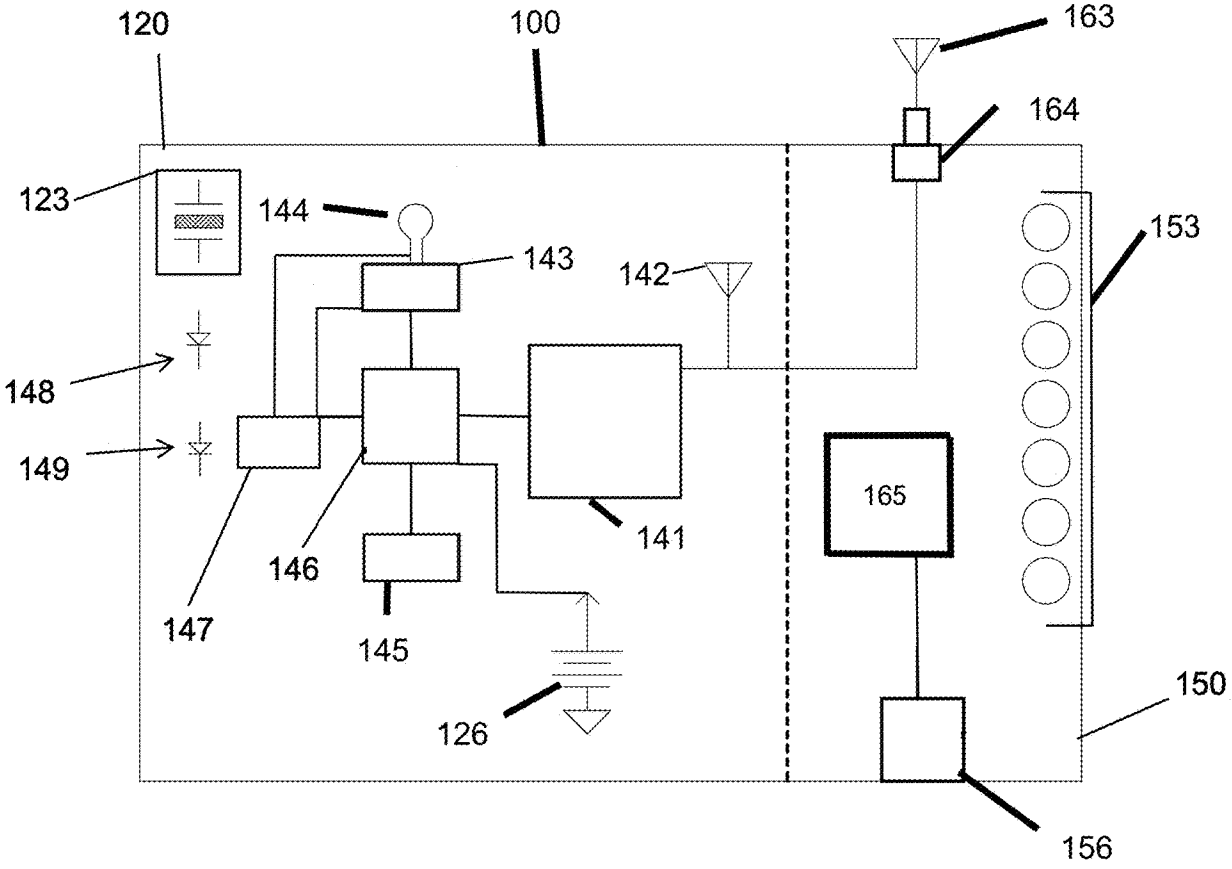
FIG. 4 illustrates a block diagram of the wireless security fob and the base station.

One aspect of the present disclosure discusses that previous display solutions implemented by retailers can be alleviated or resolved by the implementation of a wireless security system. This can be particularly helpful for small, highly valuable articles, such as, but not limited to, electronic devices that are designed to be manipulated by a user's hand (e.g., smart styluses or smartpens). A wireless security fob can be securely attached to a small consumer electronic device in conjunction with a wireless security system used to monitor the location of that small electronic devices and to allow a realistic hands-on experience for consumers experimenting with the small electronic devices.

Another aspect of the present disclosure includes various manners of attaching the security fob to a small device (e.g., a smartpen). One goal is to reduce physical weight and other factors that may detract from the writing experience of consumers with the smartpen. For example, the security fob can include a security loop built into one end of the housing. A security tether can extend between the smartpen and the security loop. One end of the security tether can extend through the security loop. Another end of the security tether can be anchored to or embedded within the smartpen. For example, a hole can be provided in an outer housing of the smartpen through which the security tether can extend. In some embodiments, the end of such a tether can be larger than an opening in the pen's structure or otherwise configured such that it cannot be removed from the outer housing without disassembling and/or breaking the smartpen.

Another aspect of the present disclosure includes enabling the monitoring of multiple devices by one or more employees of a retailer. In certain implementations, this can include alarms and/or flashing lights or other sensory signaling devices on the security fob and/or the base. In certain implementations, this can include a perimeter and/or a predetermined distance from the base beyond which the security system will either send an alarm or a warning that a security fob has exceeded or is approaching either the perimeter or the predetermined distance. The perimeter size can be specifically tailored to a retail environment where consumers are expected to experiment with devices by moving them freely within the perimeter—including manipulating them extensively and even placing such devices in their pockets or purses. However, the perimeter can be set such that outside an area of several feet or yards, such movement is not permitted without tripping an alert or alarm, as described further below.

Another aspect of the present disclosure includes an easy way to pair and unpair multiple security devices (e.g., fobs) using an administrator device (which can comprise a separate fob or base unit and can employ near field communication or NFC, for example).

Another aspect of the present disclosure includes prolonging the battery life of a security device (e.g., fob or base station). Prolonging battery life can be accomplished by enabling one or a series of modes (e.g., sleep mode, doze mode, high alert mode, etc.), and by tuning power usage in various other ways. The relevant modes and power usage tuning can be dynamically programmed by predicting normal usage patterns. Alternatively or additionally, these modes can be programmed, set, or recognized from actual usage patterns. A system can store information about such patterns to assist in providing more effective demonstrations of the device.

Another aspect of the present disclosure includes bilateral communication between devices (e.g., a base and one or more security fobs) using ultra-wideband signal technology. The wide band technology can assist in providing frequent signal communications and provide enough bandwidth to secure multiple devices. It can also be used to reduce or manage interference and interaction with other existing networks and protocols.

With reference to FIG. 1, a wireless security system 10 is designed to provide security for a valuable asset 1 while also allowing for the valuable asset 1 to be displayed (e.g., freely handled or demonstrated) to a person, such as a consumer. In some implementations, the wireless security system 10 can be used in a retail store or a tradeshow environment in which the valuable asset 1 and/or a plurality of valuable assets can be tracked by the security system 10. This wireless system 10 facilitates security of the valuable asset 1 and also allows any of the users or consumers to freely handle the valuable assets 1 within a designated area. The wireless security system 10 can be especially important where the valuable asset 1 is particularly expensive or where securing sales of the valuable asset 1 are particularly dependent on a user's satisfaction in handling or manipulation of the valuable asset 1. An example of an implementation for the system 10 is a display for a stylus or a smartpen (e.g., MICROSOFT® Surface Pen) for a tablet computer or smartphone or similar electronic device. The wireless security system 10 can allow consumers to write freely with the smartpen in a manner that is very similar to using the smartpen without any security device attached to it.

The wireless security system 10 can include a security fob 20. The security fob 20 can be physically tethered to the valuable asset 1 via security tether 30. In some embodiments of the wireless security system 10, the security tether 30 can be a short chain, cable or similar durable and/or flexible material that connects the valuable asset 1 with the security fob 20. Having a separate security fob (as opposed to an embedded security device) can allow such fobs to be transferred between various sample objects and reused, thereby reducing cost. The fobs can also act as an initial visual security warning to would-be larcenists, thereby providing a disincentive to even attempt a theft. Alternatively, a security fob can have such a low profile that it is not readily apparent to customers at first. This can change when it emits a warning sound or light, for example.

In some implementations, the security fob 20 can be left to dangle freely from one end of the valuable asset 1 by the security tether 30. For example, the security fob 20 can be left to dangle from one end of a smartpen while enabling the smartpen to be freely handled by a consumer (e.g., for writing). By enabling the security fob 20 to be flexibly connected with the valuable asset 1, the consumer's experience in handling and manipulating the valuable asset 1 can be very similar to manipulation and usage of the valuable instrument 1 without any security device attached to it. The presence of the security fob 20 can become essentially non-detrimental where the security tether 30 and the security fob 20 are lightweight and/or unobtrusive when attached to the valuable object 1.

The security fob 20 can have a strong physical connection to the valuable asset 1. For example, the security fob 20 can be mechanically fastened (e.g., by glue, bolts, screws, ball and socket, anchor chain, or other mechanical fasteners) to the valuable asset 1. Similarly to the tethered security fob 20, the consumer's experience with the securely attached security fob 20 can be similar to usage of the valuable asset 1 without any security device attached to it. In some implementations, the valuable object 1 can be modified to connect with the security fob 20 or the security tether (e.g., a hole can be drilled in the valuable object 1 for looping or anchoring the security tether). In some embodiments, a tether and securing mechanism can be physically integrated with the valuable asset 1 such that application of sufficient force to remove the tether would also destroy some aspect of the valuable asset 1. This would tend to deter a larcenist because it would destroy the value of the asset by the very act of attempted theft, and applications of lesser force would be unsuccessful in separating the tether or other attachment system from the valuable asset 1. The tether can be formed of a cut-resistant material, such as braided steel cable.

The wireless security system 10 can provide a designated area or outer perimeter 40, within which the consumer can use the valuable asset 1. The security system 10 can provide security for the valuable asset 1 by warning a user of the security system 10 when the valuable asset 1 leaves the designated area and/or leaves or approaches the outer perimeter 40. The wireless security system 10 can also warn or alert the consumer or person handling the valuable asset 1 when it is taken into a predetermined proximity to the outer perimeter 40. The warning system of the wireless security system 10 can include any sensory based signal that will alert a human, such as the consumer or a user of the wireless security 10, that the valuable assets 1 has moved beyond the designated area.

In some embodiments, the designated area can be defined by the outer perimeter 40. The outer perimeter can be generally circular about a central location. In such an embodiment, the designated area can be determined using a radius from a base station that emits signals radially, for example. In some embodiments, the security system 10 can track a distance 42 that the valuable asset is from the central location (e.g., the radius from the central location). In some implementations, the perimeter 40 is defined in terms of a specific distance. In other implementations, the perimeter 40 can be defined in terms of a distance and a margin or error or a range of distances. In other implementations, the perimeter 40 is a shape other than circular. The location of the security fob 20 within the perimeter 40 can be determined by the wireless security system 10.

The wireless system 10 can also include a sub-perimeter 44 within the outer perimeter 40. Like the outer perimeter 40, the sub-perimeter 44 can be defined in terms of a distance and a margin or error and/or a range of distances or otherwise defined (e.g., polygonal or other). Movement of the valuable asset 1 into or beyond the sub-perimeter 44 can trigger a warning from the security system 10. The warning can alert the user of the security system 10 and/or the consumer who is handling the valuable asset 1. Warning the consumer handling the valuable asset 1 can gently indicate or 'nudge' the consumer to move back toward the central location and not proceed further toward the outer perimeter 40. Different warning intensities can be used. For example, approaching or crossing the sub-perimeter 44 can be associated with a vibration or other alarm and approaching or crossing the outer perimeter 40 can be associated with an audible alarm or other alarm. Intensity of a series of such warnings can be graduated and adjusted to the circumstances by selecting different modes, for example. In other embodiments, a single warning intensity may suffice and reduce production costs and setup time. A warning can be haptic, audible, visual, and/or a combination thereof.

Warning the user of the security system 10 can alert the user to pay attention to a particular consumer and/or valuable asset 1. In some embodiments, the wireless system 10 can indicate to the user (e.g., a store clerk or store security personnel) which of a plurality of the valuable assets is implicated (e.g., which valuable asset has moved beyond or into proximity to the outer perimeter 40 or the sub-perimeter 44).

The security fob 20 can be wirelessly and communicatively coupled with a base station 50 of the wireless security system 10. The base station 50 can be in communicative contact with the security fob 20 via any practicable radio frequency. Communication (e.g., the sending of signals or data packets) between the base station 50 and the security fob 20 can be used to determine the distance 42 between the security fob 20 (and the valuable asset 1) and the base station 50. An associated device such as the security base station 50 can serve as the central location within the outer perimeter 40. In embodiments with a generally circular outer perimeter 40, the base station 50 can be located at a center of the generally circular outer perimeter 40. The outer perimeter shape can vary based on interference or other factors that affect signals. A usable portion of a perimeter may form a semi-circle that is partially bounded by a wall of a retail store, for example.

The distance 42 can be calculated using any available methods including measuring the time of flight (TOF) of signals or packets sent wirelessly between the security fob 20 and the base station 50. Distance can be determined geometrically using triangulation from one or more signal sources over one or more intervals. Distance can also be measured by knowing the speed at which the signals travel and having synchronized clocks within one or more devices. If the departure time, speed of flight, and arrival time is known, total distance traveled can be readily calculated. Other methods can also be used to determine distance.

When the security system 10 detects that the distance 42 of the security fob 20 and/or the valuable asset 1 exceeds or enters into a predetermined proximity to the outer perimeter 40, the security fob 20 and/or the base station 50 can emit an alarm. For example, the security fob 20 and/or the base station 50 can include any of a speaker, lights or vibration motor for alerting the users and/or consumers. In some implementations, the user of the wireless system 10 can be a retail store employee who is facilitating or watching over the display of the valuable asset 1. When the security fob 20 and/or the base station 50 emits an alarm, the user can be made aware that the security fob has exceeded the predetermined proximity to the outer perimeter 40 and can take appropriate action. This awareness can be accomplished through a visible, audible, or haptic (e.g., vibrational) signal. It can occur remotely (e.g., at a register or in a security booth) or it can occur in the immediate vicinity of the merchandise display area. It can be emitted from the valuable asset 1 itself, from a base station, from a store audio system, from an alarm installed on the display hardware, etc. The consumer handling the valuable object 1 to which the security fob 20 is attached can also be made aware.

In some embodiments, a consumer can be gently informed (e.g., using a haptic alert) that he or she is approaching the perimeter 40 or 44 prior to a full alarm ringing or emitting throughout a larger area. Similarly, the security fob 20 or the base 20 can alert when the security system detects that the distance 42 has exceeded or entered into proximity to the sub-perimeter 44. In some embodiments, such an initial alert or sub-alert (or series thereof) can be quieter or otherwise less intense than an alarm associated with the outer perimeter 40. For example, the alert can include only alerting the user and/or consumer with a flashing LED, while the alarm can be audible. In certain implementations, the security fob 20 can alert (e.g., as the user approaches or passes the sub-perimeter 44) before the base 50 alerts.

The wireless security system 10 can also include an administrator device, illustrated here as an administrator fob 60. The administrator fob 60 can facilitate pairing of the security fob 20 with the base station 50. Pairing can link the wireless communications systems between the base station 50 and the security fob 20. For example, the components of the security system 10 can include a wireless communication protocol such as near field communication (NFC) for pairing the base station 50 with the security fob 20. Usage of the administrator fob 60 can include placing the administrator fob 60 adjacent to and in communication with the base station 50 and also placing the security fob 20 adjacent to and in communication with the base station 50. This can pair together the security fob 20 and the base station 50 such that the security fob 20 is uniquely identified to the base station 50. To unpair the security fob 20 from the base station 50, the administrator fob 60 and the security fob 20 can again be placed adjacent to (e.g., in communicative contact with via NFC) the base station 50. In some embodiments, the administrator fob 60 can be first presented to the base station 50 and the security fob can be presented within a specified time limit (e.g., 10 seconds). In some embodiments, after an alarm or alert occurs, the administrator fob 60 can be presented to silence or otherwise end the alarm or alert.

In some streamlined implementations of the security system 10, the base station 50 is not provided with any exterior or interior buttons or user interface other than the administrator fob 60. The administrator fob 60 can provide a secure and easy-to-use wireless security system. The administrator fob 60 can be used to pair and unpair a plurality of security fobs 20. The administrator fob 60 can include NFC capabilities. In such an approach, bringing the fob 60 into proximity with a base or another fob can automatically trigger in one or more of the devices a pairing process. In a simple binary switch mode, bringing the same fob 60 into proximity again can automatically trigger an unpairing process. In some implementations, the wireless security 10 can be utilized to secure a plurality of valuable assets 1. All of the security fobs 20 in the plurality can be similar to the security fob 20.

FIGS. 2A-4 illustrate an embodiment of a wireless security system 100 similar to and implementing functions of the wireless security system 10 described above. FIG. 2 is an embodiment of a wireless security fob 120. The security fob 120 can include an external housing 121. The external housing 121 can include an upper housing 120*a*, 121*a* and a lower housing 121*b*. The upper and lower housings 121*a*, 121*b* can define an interior cavity of the housing 121. The external side of the housing 121 can include a label 121*c*. The label 121*c* can include any instructions or logos associated with the wireless security system 100 or the valuable object 1. For example the label can include information about the allowable perimeter of the security system. The label can include a warning about moving the security fob 120 beyond the outer perimeter of the wireless security system 100. The housing 121 can include an electronics assembly 125.

The housing 121 can include a security loop 122. In some embodiments, the security loop 122 is built integrally with the housing 121. The security loop 122 can be built into one end of the security fob 120. In some embodiments, the security loop can extend all the way through between opposite sides of the housing 121 such that a security tether (not shown) can be coupled with the security fob 120 at the security loop 122. In some embodiments, even where the housing halves 121*a*, 121*b* are separated, the security loop 122 can still form a complete loop thereby still providing a connection between the security fob 120 and the security tether. In some embodiments, the housing 121 can include a security feature extending from the housing 121 in addition to the security tether or in place of the security tether. The security feature can be configured to couple with the valuable object 1. For example, the security feature can be a screw, clasp or hook that interfaces with the valuable object 1.

The housing 121 can include a sound hole or output or a piezo electric device such as a speaker 123 or vibration mechanism. In some embodiments, the housing 121 can include a resonance chamber for increasing the volume of an output sound from the speaker 123. In some implementations of the wireless security system 100, the speaker 123 can act as the alarm for the wireless security system 10. In some embodiments, the speaker 123 is a piezoelectric speaker. The housing 121 can include a hole for an LED output 129. In some implementations of the wireless security system 100, the LED output 129 can act as the alarm or alert for the wireless security system 10 (e.g., by flashing). In some embodiments, the LED output 129 can indicate the charge level of the power to the security fob 120.

The wireless security fob 120 should have a small and lightweight profile and can generally be lightweight to facilitate unobtrusiveness when used in conjunction with the valuable asset 1. For example, the security fob can be less than 2 inches in length and less than or approximately 0.25 inches in thickness and approximately 1 inch wide. The security fob 120 should have a generally aesthetically pleasing profile so as not to detract from the experience of the user in handling the valuable object 1.

The housing 121 can be configured to be tamper proof In one implementation, the upper and lower housing halves, 121*a*, 121*b* can be coupled together by a nonstandard bolt or screw 124 (e.g., torq-set, torx, security torx, or tri-groove). The bolt or screw 124 can extend through the upper housing 121*a* and into a threaded hole 124*a* within the lower housing 121*b*. In some embodiments, the security screw 124 can be configured to prevent easy or convenient disassembly of the security fob 120. The upper and lower housing halves 121*a*, 121*b* can be fitted together such that there is no edge or space between them that would facilitate a consumer or other unauthorized person from prying apart the two halves of the housing 121. In some embodiments, the separation of the halves can trigger an alarm at the base 10. The housing 121 can include an LED hole 128 through which a LED output can be seen and/or extend. In one implementation, the LED can be used to indicate the status (e.g., pair status, low battery, proximity to outer perimeter, etc.) of the fob 120. In one implementation, the lower housing halve 121*b* can include an extension 121*d* that fits within a slot (not shown) within the upper housing halve 121*a*. Thus, only one screw 124 is required to close the housing 121.

The security fob 120 can further include an electronic assembly 125. The electronic assembly 125 can include an electronics board. The electronics assembly 125 can be configured to be low-power operating. The electronic assembly 125 can in some embodiments include the speaker 123 (e.g., a piezoelectric, or any other type of speaker), the LED output and a power supply 126. In one implementation, the housing 121 includes a hole 129 and/or a plurality of holes for emitting sound through the housing 121. In some embodiments, the power supply 126 can be in the form of a coin cell battery or lithium polymer technology battery. The profile of a coin cell battery can be optimal for fitting with the housing 121 and maintaining a thin and unobtrusive profile for the security fob 120. In one implementation, the piezoelectric device 123 can be used to provide haptic feedback to the user (e.g., a holder of the object 1 to which the fob 120 is attached). In one implementation, the haptic feedback can be provided when it is detected that the fob 120 is proximate and/or over the outer perimeter 40. In one implementations the fob 120 includes one or more protruding electrodes for delivering a shock to the user. The electrodes can deliver electricity to deliver the shock during an alarm event.

The electronics assembly 125 can include a status LED 148 and/or a power status LED 149. The status LED 148 can indicate to a user of the wireless security system their location relative to the outer perimeter (e.g., perimeter 40). For example, the status LED 148 can indicate first color when the fob 120 is detected to be within the perimeter, a second color when the fob 120 is detected to be proximate the perimeter 40 and a third color when the fob 120 is detected to be outside the perimeter 40.

Advantageously, the power supply 126 can last for up to a year with normal use because of the low-power circuitry of the security fob 120. To facilitate this, the electronic assembly 125 can further include an accelerometer 145. The accelerometer 145 can be used to enable the security fob to enter into a sleep mode to save energy. One or more levels of battery saving modes can be used. For example, sleep mode can shut down or limit communication between the security fob 120 and other components of the security system 100. A sleep mode can also shut down or limit any of the alarms, speakers 123, LED output 129, or any other feature of the security fob 120. The sleep mode can be activated when the accelerometer fails to detect any movement of the security fob for a designated time (e.g., 15 seconds). The sleep mode can be turned off when the accelerometer detects movement of the security fob again. Periodically during the sleep mode, the security fob can restart and send a wireless ping to the rest of the security system 100. Multiple levels or combinations of sleep modes can be used. The ping can include information to be used to determine the location of the security fob 120 and/or to determine the level of the power supply 126. The wireless security system 100 can thus ensure that the security fob 120 is still communicable and/or operational.

The wireless security system 100 can include a base station 150. The base station 150 can include a housing 151. The housing 151 can contain an internal electronic circuit 155. The electronic circuit 155 can communicate with the security fob 120 wirelessly. The electronic circuit 155 can be powered by a power supply 156. In some embodiments, the power supply 156 can be a USB connector input or other type of direct-current input.

The housing 151 can include a visual indicator panel 153. For example, the housing 151 can include apertures through which extend or shine a plurality of LEDs or other visual indicators. In some embodiments, one LED of the plurality of LEDs can correspond to the security fob 120. In implementations of the security system 100 with multiple security fobs associated with the base station 150, each of the security fobs can correspond uniquely to one or more of the LEDs. The LEDs can indicate information about the wireless security system 100. For example, the LEDs can indicate the pair status, battery level, alarm or alert level of each of the security fobs in the security system 100. In some embodiments, the LEDs can include tricolor LEDs. Each of the three colors in the tricolor LEDs can correspond to different states of the security fob 120. For example, the three colors might be red, yellow and green. The green can indicate whenever the security fob 120 is within the perimeter 40 and the sub-perimeter 44 of the security system 100; the LED can indicate yellow when the security fob 120 is proximate the outer perimeter 40 (e.g., outside of the sub-perimeter 44 but still within the outer perimeter 40); and the LED can indicate red when the security fob 120 is outside the outer perimeter 40 of the security system 100. In some embodiments, this can also be coupled with an alarm at either or both of the yellow and red states of the LEDs. In some embodiments, the LEDs can indicate the state of the power supply of the security fob 120.

The security fob 120 can be in wireless communication with the base station 150. The security fob 120 can include an ultra-wideband transceiver 141 that can communicate with an external antenna 163 of the base station 150. The external antenna 163 can be coupled with a coaxial coupler 164 or other suitable coupler to the base station 150.

The electronic assembly 125 of the security fob 120 can include an antenna 142 for use in conjunction with the ultra-wideband transceiver 141. The antenna 142 can be a chip or trace antenna or other type of antenna and can send and receive the wireless communications for the ultra-wideband transceiver 141. Other types of wireless communication (e.g., WIFI or BLUETOOTH) can be utilized with the current system. The fob 120 can include a Bluetooth chip, such as a low-power Bluetooth chip 147 in the electronics assembly 125. It has been discovered that an advantageous amount of precision in detecting the location of the security fob 120 (versus the high cost and large size factors offered by similar components in other wireless systems) can be achieved by using an ultra-wideband transceiver, illustrated here as transceiver 141. An exemplary transceiver is SCENSOR DW1000 sold by DECAWAVE.

The security fob 120 can also include a near field communication (NFC) chip 143. The near field communication chip 143 can include a small coil antenna 144. The antenna 144 can be located elsewhere in or on the security fob 120 and connected to the NFC chip 143. The small coil antenna 144 can function to broadcast the electromagnetic field from the NFC chip 143.

An administrator fob 160 with NFC can be used to pair the security fob with the base station 150. The NFC system can be used to link the ultra-wideband transceiver 141 with the external antenna of the base station 150. NFC is a set of communication protocols that will enable two electronic devices to communicate and requires that they are brought to close proximity to each other. Thus NFC provides an inherent security system such that only physically proximate devices (e.g., the administrator fob 160) can communicate with each other. Near NFC systems can include an active NFC chip and a passive NFC chip (or an active NFC chip that is acting in a passive capacity). The active NFC chip can generate a field that will activate a solenoid that is the passive NFC chip. The interaction of the field generated by the active NFC chip with the field generated by the passive NFC chip can contain coded bits of information (such as identifiers for a security fob) that enables communication between the passive and active components of the NFC system.

In the wireless security system 100, the NFC chip 143 can include an active NFC chip 143 powered by the power supply 126. The base station 150 can include a passive NFC chip. The passive NFC chip can include information allowing the NFC chip 143 to pair the wireless transceiver 141 with the base station 150 (e.g., the antenna 163 and controller 165) (e.g., bootstrapping). This can allow the base station 150*a* to uniquely identify the security fob 120 within the wireless system 100. The administrator fob 160 can include an active or passive NFC chip.

In some embodiments, the active NFC chip can be in the base station 150 and a passive NFC chip can be included in each of the security fobs 120. The passive NFC chip can include information allowing each security fob 120 to pair with the base station 150 and be uniquely identified by it. The base station 150 can be activated into a pairing mode by the administrator fob 160. In the pairing mode, one of the security fobs 120 can be paired. The administrator fob 160 can also be used to unpair the security fobs in similar manner.

The security fob 120 can include a controller 146 (e.g., a microcontroller). The controller 146 can include a machine readable medium with instructions stored thereon for operating the security fob 120 and/or other components of the security system 100. The security fob 120 can include a processor for executing the stored instructions. The instructions can include instructions for sending and/or receiving a signal between the transceiver 141 and the base station 150, measuring the time of flight of the signal to determine a distance of the security fob 120 from the base station 150 and comparing the distance with one or more parameters, such as those indicating the location of the outer perimeter or sub-perimeter (e.g., a distance from the base station 150). Depending on the distance of the security fob 120 form the base station 150, the instructions when executed by the controller 145 can trigger an alarm or indicate and alert on either or both of the base station 150 and the security fob 120. The parameters can be predetermined and hard coded into the instructions on the computer readable medium of the controller 146. In other embodiments, the predetermined thresholds can be programmable by a user such as by connecting a programmable component of the security fob 120 with a computer or other input device. In some embodiments the programmable content can change the outer perimeter, sub-perimeter or other parameters of the security system 100.

The instructions of the controller 120 can also include instructions for receiving and transmitting information about the security fob 120 to the base station 150 or vice-versa. For example, the controller can measure the power supply 126 (e.g., battery level) and relay this information to be indicated by the output LEDs 153 on the base station 150. For example, this information can include indications that the power supply is within an acceptable range and/or the power supply needs replacement soon.

The instructions of the controller 120 can also include instructions for sleeping and waking the security fob 120 using the accelerometer 145, as described above. The instructions of the controller 120 can also include instructions for pairing and unpairing the security fob 120, as described above.

The external antenna 153 can transmit wireless signal from the security fob 120 to a controller 165. The controller 165 can be in some embodiments disposed within the housing 151 of the base station 150. The controller 165 can execute instruction stored on a computer readable medium for controlling the LEDs 153 and/or an alarm and/or a near field communication chip disposed on the base station 150. In some embodiments, the functions described above for the controller 120 can be shared between or performed entirely by the controller 165. The controller 165 can include a low power microprocessor.

Figure 5:
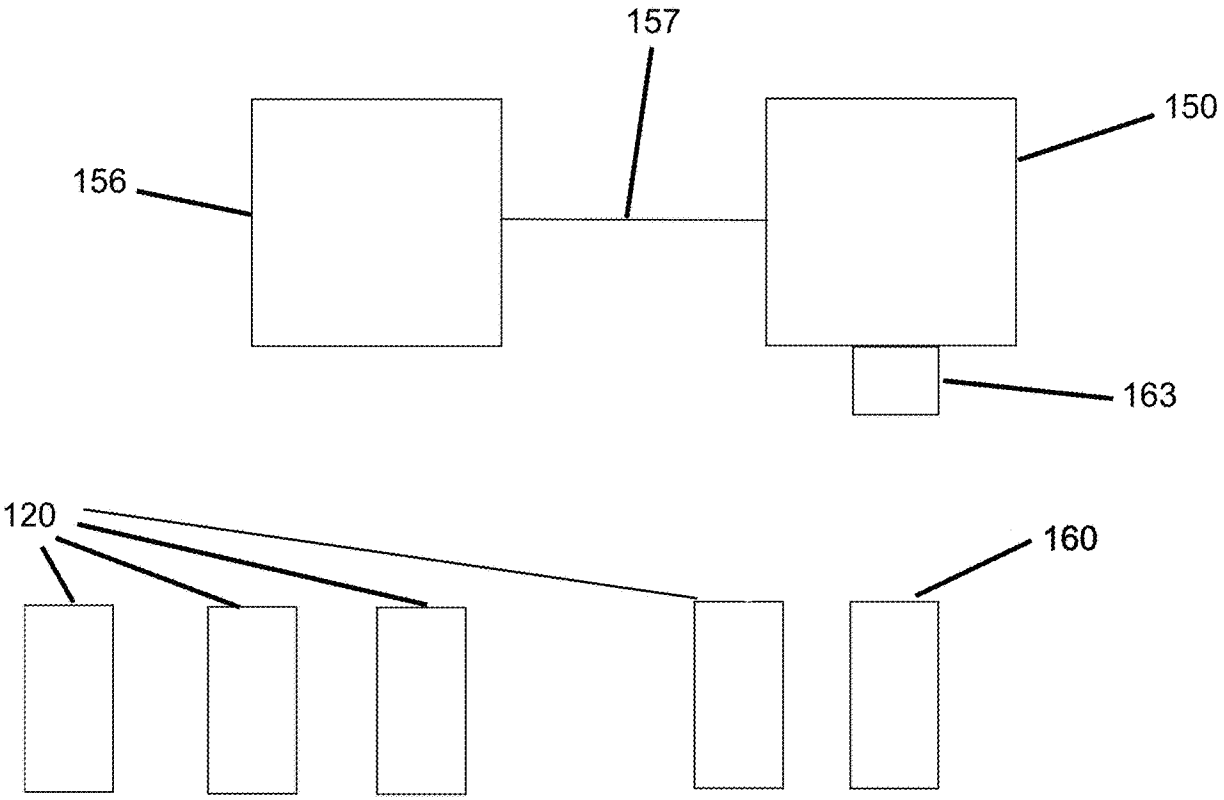
FIG. 5 illustrates a schematic embodiment of wireless security system.

FIG. 5 illustrates a schematic view of a wireless communication system 200 having multiple fobs 120 and the administrator fob 160. The wireless communication system 200 can include a power supply 126 (e.g., USB power supply). The external power supply can provide additional power for enabling the system 200 to last for a full year. The base station 150 can include an external antenna 163 for communicating (i.e., using ultra-wideband transceivers) between the security fobs 120 and the base station 150.

Figure 6:
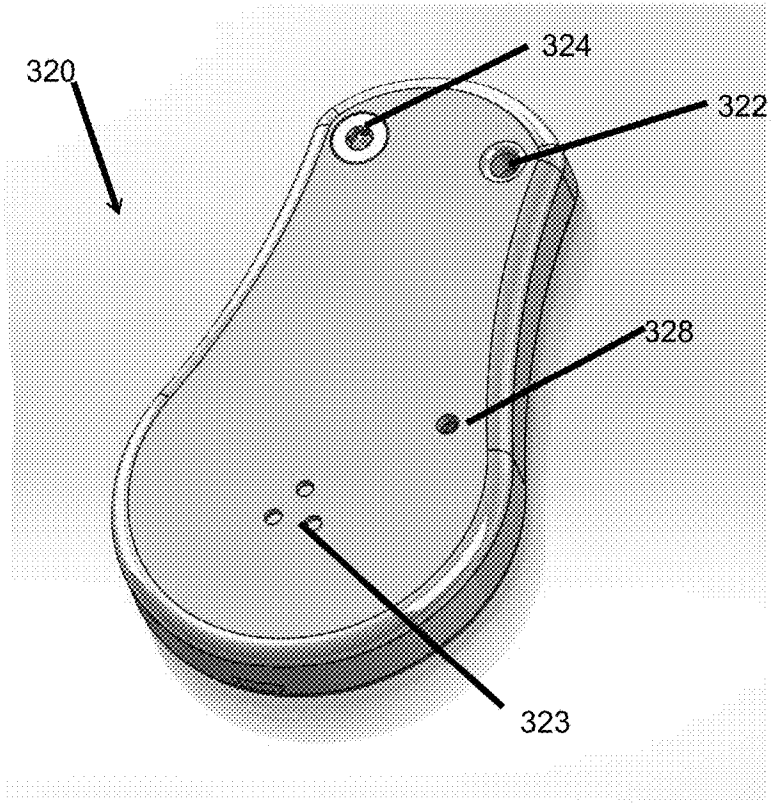
FIG. 6 illustrates another embodiment of a wireless security fob.

Security fob 320, illustrated in FIG. 6, can include a housing 321, a sound hole 323 corresponding to a speaker, and an LED output hole 328. Housing 321 can include a security loop 322 in the form of a hole through the housing 321. The security loop 322 can be configured to couple with (i.e., anchor to) one end of the security tether for coupling the security fob 320 with the valuable object 1. The housing 321 can further enclose an electronic assembly 325 (not shown, similar to assembly 125). The electronic assembly 325 can include components for communication between the hub 320 and a wireless security system 300, similar to the systems and functionalities described above in the security fobs 20, 120, and 220. Item 328 can be an indicator such as a light-emitting diode (LED).

Some embodiments can include a Bluetooth implementation, including for pairing devices. In particular, the security fob can exchange data with a base over short distances using UHF radio waves from 2.4 to 2.485 GHz (the 2.4 GHz short-range radio frequency band). These signals can establish a personal area network (PAN). This implementation can conform with IEEE802.15.1, for example. Short-link radio technology can be used, with reference to the principles described in Swedish patents SE 8902098-6 and SE 9202239, for example. Such an implementation can incorporate frequency-hopping spread spectrum technology. The operating frequencies for Bluetooth can include guard bands (e.g., 2 MHz wide at the bottom end and 3.5 MHz wide at the top). Such an implementation can be packet based, where packets of information are transmitted on one of multiple (e.g., 79) designated Bluetooth channels having bandwidths of 1 MHz, for example. Although some Bluetooth performs 800 hops per second, a useful implementation here uses lower energy with 2 MHz spacing (accommodating 40 channels). This can save battery power and lengthen the useful life of a fob, for example, especially when combined with a sleep or dormant mode. Bluetooth can incorporate a master/slave architecture where a master communicates with various (e.g., seven) slaves in a piconet (e.g., and ad-hoc computer network) and all devices share the master's clock. Packet exchange can be based on slots (e.g., two clock ticks can be a slot of 625 microseconds). The master and slave devices can use designated (e.g., odd and or even) slots, and packets can be multiple (e.g., 1,3, or 5) slots long. Multiple piconets can establish a scatternet, where certain devices fill the role of master in one net and slave in another. A scatternet implementation can be particularly useful if there are more than seven valuable retail assets to be alarmed or protected.

In some low energy applications, the Bluetooth can use frequency hopping to counteract narrowband interference problems. A Bluetooth Low Energy (or BLE) protocol can be used to maximize battery life, given the retail parameters of the present application. For example, peak current consumption using this protocol can be less than 15 miliAmps, and power consumption can be between one tenth to one half of that for regular Bluetooth protocols. Under these and other related wireless protocols, power consumption can be reduced and the short range can be achieved even with low-cost transceiver microchips in associated devices. The devices can use radio communications and therefore do not require visual line of sight. Ranges of Bluetooth devices vary by class, but the classes supporting one to ten meter ranges are most relevant for most limited perimeter retail security applications such as those described herein. Thus, Class 2 (approx. 10 meter range) may be useful to employ in this context. Bluetooth can be particularly helpful to pair devices—e.g., a base station and a security fob connected to a valuable but non-bulky retail asset.

Security fobs and base stations can also employ Wi-Fi technology to achieve the alarm and security functions described here. These implementations can be based on the IEEE 802.11 direct sequence standards. Wi-Fi implementations can established connections over distances that can be greater (e.g., 20 meters) than low-power implementations of Bluetooth. Radio bands on 2.4 and 5.8 GHz frequencies are commonly used. Although some implementations can establish a base station with all fobs communicating with this central location (e.g., located in a display table or display case), a Wi-Fi ad-hoc mode can also be employed where the devices communicate directly with each other. Wi-Fi can be particularly useful in updating firmware for the fobs and/or base-station, as each can connect to a retail store's existing Wi-Fi network for example. Firmware updates can be pushed or pulled to and/or from the relevant devices (e.g., base stations and fobs). These updates can be useful in configuring a security system for use in other countries that employ different radio spectrum standards, partitioning the spectrum in different ways and allowing usage of different frequencies, with different channels (having different overlap characteristics) etc. Wi-Fi implementation can include streaming data between devices and up to the cloud. Such implementations can cause dormant mode as a default when a device is not being used or tested to save battery life and avoid transmissions for network searching that can reduce battery life quickly. Another radiofrequency protocol that is useful for some embodiments this application is near field communication (NFC). This can be used for pairing devices because of the close proximity and lower power requirements, similar to BLE.

Inclusion of an accelerometer in a security fob can be particularly useful to allow the fob to recognize when dormant mode (or power saving mode) may be appropriate and when to establish or avoid a live link (e.g., via Wi-Fi, Bluetooth, or some other RF protocol). An accelerometer can send a signal when a sudden tipping (with respect to an established baseline axis) occurs. Some accelerometer can include three-dimensional axis sensitivity, however, to determine whether movement is occurring in a binary fashion (yes or no), fewer axis may be required. Limiting the number of axes can reduce cost, complexity, size, and power consumption, for example.

In some implementations, a piezoelectric buzzer can be employed (in place of or in addition to a standard speaker or another type of sensory-based, e.g., audible or visual alarm). Such a buzzer can also be considered a haptic device given the physical movement that can result. A piezo electric element is a crystal or ceramic that deforms slightly under an applied voltage. An alternating current (AC) voltage can be applied to some such devices at a frequency of a few thousand cycles per minute, deforming the device at the same frequency and producing an audible sound and/or haptic effect. A piezo implementation can be especially useful in this context to establish an alarm that is triggered if a high-value retail asset crosses a threshold or leaves a certain perimeter from a base station or other physical location. To save power, a piezo alarm can be modulated to only sound or buzz periodically and can be combined and or alternated with a light emitting diode for greater alarm efficacy and power savings. LED implementations can be used for both diagnostic and alarm applications. For example an LED can light up (or establish a pattern) to indicate a software status, a battery state, a distance or physical status, completion of a protocol, acknowledgement or transmission of a signal, etc.

Terminology and Conclusion

Conditional language used herein, such as, among others, "can," "might," "may," "for example," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a" and "an" are to be construed to mean "one or more" or "at least one" unless specified otherwise.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present.

While the above detailed description has shown, described, and pointed out novel features as applied to various embodiments, it will be understood that various omissions, substitutions, and changes in the form and details of the devices or algorithms illustrated can be made without departing from the spirit of the disclosure. Thus, nothing in the foregoing description is intended to imply that any particular feature, characteristic, step, module, or block is necessary or indispensable. As will be recognized, the processes described herein can be embodied within a form that does not provide all of the features and benefits set forth herein, as some features can be used or practiced separately from others. The scope of protection is defined by the appended claims rather than by the foregoing description.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics may be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment. Accordingly, no feature or group of features is necessary or indispensable to each embodiment.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

Broadly Applicable

Although this disclosure is made with reference to preferred and example embodiments, the systems and methods disclosed are not limited to the preferred embodiments only. Rather, a skilled artisan will recognize from the disclosure herein a wide number of alternatives. Unless indicated otherwise, it may be assumed that the process steps described herein are implemented within one or more modules, including logic embodied in hardware or firmware, or a collection of software instructions, possibly having entry and exit points, written in a programming language, such as, for example C++. A software module may be compiled and linked into an executable program, installed in a dynamic link library, or may be written in an interpretive language such as BASIC. It will be appreciated that software modules may be callable from other modules or from themselves, and/or may be invoked in response to detected events or interrupts. Software instructions may be embedded in firmware, such as an EPROM or EEPROM. It will be further appreciated that hardware modules may be comprised of connected logic units, such as gates and flip-flops, and/or may be comprised of programmable units, such as programmable gate arrays or processors. The modules described herein are preferably implemented as software modules, but may be represented in hardware or firmware. The software modules may be executed by one or more general purpose computers. The software modules may be stored on or within any suitable computer-readable medium. The data described herein may be stored in one or more suitable mediums, including but not limited to a computer-readable medium. The data described herein may be stored in one or more suitable formats, including but not limited to a data file, a database, an expert system, or the like.

Although the foregoing systems and methods have been described in terms of certain preferred embodiments, other embodiments will be apparent to those of ordinary skill in the art from the disclosure herein. For example, although described in the context of consumer electronics (e.g., smartpens), any object to be secured or tracked may be used with embodiments of these aspects. Accordingly, the concepts represented herein may apply to any consumer or commercial good that is desired to be maintained within a limited space. Additionally, other combinations, omissions, substitutions and modifications will be apparent to the skilled artisan in view of the disclosure herein. Accordingly, the present disclosure is not limited to the preferred embodiments.

Clauses

Clause 1 A wireless, proximity-based security system for securing an object includes a base station having a housing and being connectable to a power source. The base station includes a first controller in communication with a first computer-readable memory having stored thereon executable instructions. An ultra-wideband antenna is in communication with the first controller. A speaker is for alerting a user of the system. A first NFC chip is for pairing a plurality of security fobs with the base station. The base station includes a visual indicator panel. The visual indicator panel includes a plurality of tri-color LEDs. Each of the tri-color LEDs is in communication with the first controller.

A security fob of the plurality of security fobs is securable to an object by a security loop and a security tether. The security loop locates within a housing of the security fob. A security tether couples within the security loop. The security fob includes a second controller in communication with a second computer-readable memory having stored thereon executable instructions. An ultra-wideband transceiver and second antenna are for communication with the base station. A second NFC chip is for pairing the security fob with the base station. An accelerometer is for detecting motion of the security fob. A piezo-speaker is for emitting an audible alarm. A battery cell is for providing power to the security fob components.

An administrator fob for pairing each of the plurality of security fobs with the base station. The administrator fob includes a housing and a third NFC chip for communicating with the first NFC chip of the base station. The security fob is paired with the base station to enable communication between the first controller and the second controller by first placing the third NFC chip of the administrator fob proximate the first NFC chip of the base station to generate a signal to the first controller that causes the base station to enter a pairing mode and subsequently placing the second NFC chip of the security fob adjacent to the first NFC chip of the base station to generate a pairing signal to the first controller to configure the ultra-wideband transceiver to communicate with the first controller through the ultra-wideband antenna.

One of the tri-color LEDs of the visual indicator panel corresponds to the security fob and indicates the pair status thereof by a first color. The first controller determines a location of the security fob from the base station by measuring at least one time-of-flight of a transmission on the ultra-wideband antenna between the base station and the security fob. The one of the tri-color LEDs of the visual indicator panel indicates the location of the corresponding security fob relative to an outer perimeter by a second color. The one of the tri-color LEDs of the visual indicator panel indicates the location of the corresponding security fob relative to a sub-perimeter by a third color. The speaker of the base station emits a first audible alarm when the location of the of the security fob is detected to be beyond of the outer perimeter.

The piezo-speaker of the security fob emits a second audible alarm when the location of the of the security fob is detected to be beyond of the outer perimeter. The security fob includes a sleep mode for conserving the battery cell and an active mode for tracking the location of the security fob. The security fob entering a sleep mode after a period of inactivity and entering the active mode after detecting motion of the security fob.

Clause 2 A wireless. proximity-based security system for securing an object that includes a base station, a security fob, and an administrator fob. T base station has a housing and is connectable to a power source. The base station includes a first controller, an ultra-wideband antenna in communication with the first controller and a visual indicator panel.

The security fob of a plurality of security fobs has a second controller, an ultra-wideband transceiver and second antenna for communication with the base station, and a battery cell The administrator fob pairs each of a plurality of security fobs with the base station.

One of the first and second controllers determines a location of the security fob from the base station by measuring at least one time-of-flight of a transmission between the base station and the security fob using the ultra-wideband transceiver.

A speaker of the system emits a first audible alarm when the location of the of the security fob is detected to be beyond an outer perimeter.

Clause 3 The system of Clause 2 where the base station includes a first NFC chip for pairing the plurality of security fobs with the base station. The security fob includes a second NFC chip for pairing the security fob with the base station. The administrator fob includes a third NFC chip for communicating with the first NFC chip of the base station. The security fob is paired with the base station to enable communication between the first controller and the second controller by first placing the third NFC chip of the administrator fob proximate the first NFC chip of the base station to generate a signal to the first controller that causes the base station to enter a pairing mode and subsequently placing the second NFC chip of the security fob adjacent to the first NFC chip of the base station to generate a pairing signal to the first controller to configure the ultra-wideband transceiver to communicate with the first controller through the ultra-wideband antenna.

Clause 4 The system of any of the above clauses where the security fob is securable to an object by a security loop and a security tether. The security loop located within a housing of the security fob. a security tether coupled within the security loop.

Clause 5 The system of any of the above clauses where the visual indicator panel has a plurality of tri-color LEDs. each of the tri-color LEDs in communication with the first controller.

Clause 6 The system of any of the above clauses where one of the tri-color LEDs of the visual indicator panel corresponds to the security fob and indicates the pair status thereof by a first color.

Clause 7 The system of any of the above clauses where the one of the tri-color LEDs of the visual indicator panel indicates the location of the corresponding security fob relative to an outer perimeter by a second color.

Clause 8 The system of any of the above clauses where the one of the tri-color LEDs of the visual indicator panel indicates the location of the corresponding security fob relative to a sub-perimeter by a third color.

Clause 9 The system of any of the above clauses where a piezo electric device of the security fob emits one of a second audible alarm and a haptic alarm when the location of the of the security fob is detected to be beyond the outer perimeter.

Clause 10 The system of any of the above clauses where a piezo electric device of the security fob emits a haptic alarm when the location of the of the security fob is detected to be beyond a sub-perimeter.

Clause 11 The system of any of the above clauses where the security fob includes an accelerometer for detecting motion of the security fob. The security fob includes a sleep mode for conserving the battery cell and an active mode for tracking the location of the security fob. The security fob entering a sleep mode after a period of inactivity and entering the active mode after detecting motion of the security fob.

Clause 12 A proximity alarm fob configurable for use in retail environments, the fob including a light, low-profile plastic casing configured for physical association with a valuable retail asset and shaped to enclose an electronic transceiver. A physical attachment feature facilitates the physical association between the plastic casing and the valuable retail asset. The low-profile plastic casing and valuable retail asset allow display and customer testing within an allowed perimeter distance of a base station in a retail display environment while reducing physical constraints on said testing.

A power source electrically connects to the other features of a low power microprocessor. The low power microprocessor draws down power from the power source in a limited manner over a prolonged period of time and to fit within the low-profile plastic casing. The microprocessor further includes or is electrically communicative with the following features: a clock, at least one radio frequency communication protocol for establishing a paired connection between the fob and at least one other device, a connection for firmware updates, and a security connection.

An accelerometer causes the fob to exit from a dormant mode when initially picked up after a physically dormant period, the dormant mode including less frequent or data rich radio frequency communication than a non-dormant mode. An alarm feature emits from the low-profile plastic casing.

Clause 13 The proximity alarm fob of any of the above clauses, including the physical attachment feature with a tether. One end of the tether couples with an eyelet within the low-profile plastic casing and the opposite end of the tether coupled with the valuable retail asset.

Clause 14 The proximity alarm fob of any of the above clauses, where the alarm feature includes a piezo-electric buzzer.

Clause 15 The proximity alarm fob of any of the above clauses, where the alarm feature includes an electric shock delivered a user.

Clause 16 The proximity alarm fob of any of the above clauses, where the alarm feature includes an LED.

Clause 17 The proximity alarm fob of any of the above clauses, where the alarm feature includes a speaker.

Clause 18 The proximity alarm fob of any of the above clauses, wherein the alarm features emits from a base station remote from the proximity alarm fob.

Clause 19 The proximity alarm fob of any of the above clauses, wherein the at least one radio frequency communication protocol is one of Bluetooth, Wi-Fi, and NFC.

Clause 20 A method of securing a valuable asset with a security fob in a retail environment. The method includes attaching the security fob with the valuable asset by a tether coupled within an aperture of a housing of the security fob. Pair the security fob with a base station using an NFC-enabled administrator fob, the pairing comprising. Initiate a first signal by placing the administrator fob in proximity to a NFC chip of the base station, a first controller executing instructions stored on a computer readable medium to enter a pairing mode based on the signal. Initiate a second signal by placing the security fob in proximity to the NFC chip of the base station, the first controller executing instructions stored on the computer readable medium to link a wireless interface of the security fob with the base station and to display a status of the security fob with a visual indicator panel of the base station using at least one LED.

Programming one of the security fob and the base station with an outer perimeter. Monitor the location of the security fob relative to the base station through the wireless interface in an active mode of the security fob. Enter a sleep mode of the security fob based on a signal from an accelerometer, the signal indicating no motion of the security fob detected for a predetermined time. Enter the active mode based on a signal from the security fob indicating motion of the security fob. Compare a detected location of the security fob with the outer perimeter and initiating a first alarm at the base station and a second alarm at the security fob.

The invention claimed is:

1. A wireless, proximity-based security system for securing an object comprising:

a base station having a housing and being connectable to a power source, the base station comprising:

a first controller in communication with a first computer-readable memory having stored thereon executable instructions;

an ultra-wideband antenna in communication with the first controller;

a speaker for alerting a user of the system;

a first NFC chip for pairing a plurality of security fobs with the base station; and a visual indicator panel, the visual indicator panel comprising a plurality of tri-color LEDs, each of the tri-color LEDs in communication with the first controller;

a security fob of the plurality of security fobs, the security fob securable to an object by a security loop and a security tether, the security loop located within a housing of the security fob, a security tether coupled within the security loop, the security fob comprising:

a second controller in communication with a second computer-readable memory having stored thereon executable instructions;

an ultra-wideband transceiver and second antenna for communication with the base station;

a second NFC chip for pairing the security fob with the base station;

an accelerometer for detecting motion of the security fob;

a piezo-speaker for emitting an audible alarm; and a battery cell for providing power to the second controller, the ultra-wideband transceiver, the second NFC chip, the speaker, and the accelerometer; and an administrator fob for pairing each of the plurality of security fobs with the base station, the administrator fob comprising a housing and a third NFC chip for communicating with the first NFC chip of the base station;

wherein the security fob is paired with the base station to enable communication between the first controller and the second controller by first placing the third NFC chip of the administrator fob proximate the first NFC chip of the base station to generate a signal to the first controller that causes the base station to enter a pairing mode and subsequently placing the second NFC chip of the security fob adjacent to the first NFC chip of the base station to generate a pairing signal to the first controller to configure the ultra-wideband transceiver to communicate with the first controller through the ultra-wideband antenna;

wherein one of the tri-color LEDs of the visual indicator panel corresponds to the security fob and indicates the pair status thereof by a first color;

wherein the first controller determines a location of the security fob from the base station by measuring at least one time-of-flight of a transmission on the ultra-wideband antenna between the base station and the security fob;

wherein the one of the tri-color LEDs of the visual indicator panel indicates the location of the corresponding security fob relative to an outer perimeter by a second color;

wherein the one of the tri-color LEDs of the visual indicator panel indicates the location of the corresponding security fob relative to a sub-perimeter by a third color;

wherein the speaker of the base station emits a first audible alarm when the location of the of the security fob is detected to be beyond of the outer perimeter;

wherein the piezo-speaker of the security fob emits a second audible alarm when the location of the of the security fob is detected to be beyond of the outer perimeter;

wherein the one of the tri-color LEDs indicates a low-battery status of the security fob by a third color;

wherein the security fob includes a sleep mode for conserving the battery cell and an active mode for tracking the location of the security fob, the security fob entering a sleep mode after a period of inactivity and entering the active mode after detecting motion of the security fob.

2. A wireless, proximity-based security system for securing an object comprising:

a base station having a housing and being connectable to a power source, the base station comprising:

a first controller;

an ultra-wideband antenna in communication with the first controller;

and a visual indicator panel;

a security fob of the plurality of security fobs, the security fob comprising:

a second controller;

an ultra-wideband transceiver and second antenna for communication with the base station; and a battery cell; and an administrator fob for pairing each of a plurality of security fobs with the base station;

wherein one of the first and second controllers determines a location of the security fob from the base station by measuring at least one time-of-flight of a transmission between the base station and the security fob using the ultra-wideband transceiver; and wherein a speaker of the system emits a first audible alarm when the location of the of the security fob is detected to be beyond an outer perimeter.

3. The system of claim 2:

wherein the base station includes a first NFC chip for pairing the plurality of security fobs with the base station, the security fob includes a second NFC chip for pairing the security fob with the base station, the administrator fob includes a third NFC chip for communicating with the first NFC chip of the base station; and wherein the security fob is paired with the base station to enable communication between the first controller and the second controller by first placing the third NFC chip of the administrator fob proximate the first NFC chip of the base station to generate a signal to the first controller that causes the base station to enter a pairing mode and subsequently placing the second NFC chip of the security fob adjacent to the first NFC chip of the base station to generate a pairing signal to the first controller to configure the ultra-wideband transceiver to communicate with the first controller through the ultra-wideband antenna.

4. The system of claim 2 wherein the security fob is securable to an object by a security loop and a security tether, the security loop located within a housing of the security fob, a security tether coupled within the security loop.

5. The system of claim 2 wherein the visual indicator panel comprises a plurality of tri-color LEDs, each of the tri-color LEDs in communication with the first controller.

6. The system of claim 5 wherein one of the tri-color LEDs of the visual indicator panel corresponds to the security fob and indicates the pair status thereof by a first color.

7. The system of claim 6 wherein the one of the tri-color LEDs of the visual indicator panel indicates the location of the corresponding security fob relative to an outer perimeter by a second color.

8. The system of claim 7 wherein the one of the tri-color LEDs of the visual indicator panel indicates the location of the corresponding security fob relative to a sub-perimeter by a third color.

9. The system of claim 2 wherein a piezo electric device of the security fob emits one of a second audible alarm and a haptic alarm when the location of the of the security fob is detected to be beyond the outer perimeter.

10. The system of claim 2 wherein a piezo electric device of the security fob emits a haptic alarm when the location of the of the security fob is detected to be beyond a sub-perimeter.

11. The system of claim 2 wherein the security fob includes an accelerometer for detecting motion of the security fob, the security fob includes a sleep mode for conserving the battery cell and an active mode for tracking the location of the security fob, the security fob entering a sleep mode after a period of inactivity and entering the active mode after detecting motion of the security fob.

12. A proximity alarm fob configurable for use in retail environments, the fob comprising:

a light, low-profile plastic casing configured for physical association with a valuable retail asset and shaped to enclose an electronic transceiver;

a physical attachment feature configured to facilitate the physical association between the plastic casing and the valuable retail asset;

the low-profile plastic casing and valuable retail asset configured for display and customer testing within an allowed perimeter distance of a base station in a retail display environment while reducing physical constraints on said testing; and a power source electrically connected to the other features of the microprocessor;

a low power microprocessor configured to draw down power from the power source in a limited manner over a prolonged period of time and to fit within the low-profile plastic casing, the microprocessor further configured to include or electrically communicate with the following features:

a clock;

at least one radio frequency communication protocol for establishing a paired connection between the fob and at least one other device, a connection for firmware updates, and a security connection;

an accelerometer configured to cause the fob to exit from a dormant mode when initially picked up after a physically dormant period, the dormant mode including less frequent or data rich radio frequency communication than a non-dormant mode; and an alarm feature associated with and configured to emit from the low-profile plastic casing.

13. The proximity alarm fob of claim 12, wherein the physical attachment feature includes a tether, one end of the tether coupled with an eyelet within the low-profile plastic casing and the opposite end of the tether coupled with the valuable retail asset.

14. The proximity alarm fob of claim 12, wherein the alarm feature includes a piezo-electric buzzer.

15. The proximity alarm fob of claim 12, wherein the alarm feature includes an apparatus configured for delivering an electric shock.

16. The proximity alarm fob of claim 12, wherein the alarm feature includes an LED.

17. The proximity alarm fob of claim 12, wherein the alarm feature includes a speaker.

18. The proximity alarm fob of claim 12, wherein the alarm feature emits from a base station remote from the proximity alarm fob.

19. The proximity alarm fob of claim 12, wherein the at least one radio frequency communication protocol is one or more of Bluetooth, Wi-Fi, and NFC.

20. A method of securing a valuable asset with a security fob in a retail environment comprising:

attaching the security fob with the valuable asset by a tether coupled within an aperture of a housing of the security fob;

pairing the security fob with a base station using an NFC-enabled administrator fob, the pairing comprising:

initiating a first signal by placing the administrator fob in proximity to a NFC chip of the base station, a first controller executing instructions stored on a computer readable medium to enter a pairing mode based on the signal; and initiating a second signal by placing the security fob in proximity to the NFC chip of the base station, the first controller executing instructions stored on the computer readable medium to link a wireless interface of the security fob with the base station and to display a status of the security fob with a visual indicator panel of the base station using at least one LED;

programming one of the security fob and the base station with an outer perimeter;

monitoring the location of the security fob relative to the base station through the wireless interface in an active mode of the security fob;

entering a sleep mode of the security fob based on a signal from an accelerometer, the signal indicating no motion of the security fob detected for a predetermined time;

entering the active mode based on a signal from the security fob indicating motion of the security fob;

comparing a detected location of the security fob with the outer perimeter and initiating a first alarm at the base station and a second alarm at the security fob.

* * * * *